US007086436B2

(12) United States Patent
Gottlieb

(10) Patent No.: US 7,086,436 B2
(45) Date of Patent: Aug. 8, 2006

(54) TAPERED FURNITURE LEG AND METHOD OF MAKING THE SAME

(76) Inventor: Kevin Gottlieb, 135 Tinari Dr., Richboro, PA (US) 18954

( * ) Notice: Subject to any disclaimer, the term of this patent is extended or adjusted under 35 U.S.C. 154(b) by 357 days.

(21) Appl. No.: 10/406,672

(22) Filed: Apr. 3, 2003

(65) Prior Publication Data

US 2003/0167720 A1 Sep. 11, 2003

Related U.S. Application Data

(60) Provisional application No. 60/370,845, filed on Apr. 8, 2002.

(51) Int. Cl.
*B27C 9/00* (2006.01)
*B27M 1/08* (2006.01)

(52) U.S. Cl. ..... 144/368; 144/371; 144/381; 144/1.1; 156/211; 156/268; 428/167; 52/631

(58) Field of Classification Search ..... 144/368, 144/371, 381, 2.1, 3.1, 1.1, 41; 156/257, 156/268, 221, 217, 211; 428/36.9, 167, 36.91, 428/121, 130; 229/931; 52/730.1, 730.7, 52/731.1, 731.2, 731.4, 631
See application file for complete search history.

(56) References Cited

U.S. PATENT DOCUMENTS 1,133,106 A 3/1915 Cuppett
2,181,164 A * 11/1939 Alexander ..... 52/631
2,485,648 A 10/1949 Norquist
3,654,053 A 4/1972 Toedter
3,911,554 A 10/1975 Ford
3,943,022 A 3/1976 Susnjara
3,963,546 A 6/1976 Roberti
4,352,843 A 10/1982 Eckert
4,394,409 A 7/1983 Hertel
4,402,170 A 9/1983 Seidner
4,865,807 A 9/1989 Petershofer et al.
5,427,309 A * 6/1995 Voss ..... 229/182
5,826,396 A * 10/1998 Michaels ..... 52/631
6,196,286 B1 3/2001 Susnjara
6,214,148 B1 4/2001 Hill
6,286,287 B1 9/2001 Dieter

* cited by examiner

*Primary Examiner*—Derris H. Banks
*Assistant Examiner*—Shelley Self
(74) *Attorney, Agent, or Firm*—Ceasar, Rivise, Bernstein, Cohen & Pokotilow, Ltd.

(57) ABSTRACT

A method of fabricating a furniture leg is provided which includes the steps of providing a substrate having a thin covering and routing the substrate to provide an outer peripheral configuration having a top side, a bottom side, a left side, and a right side, wherein the top side and the bottom side are each generally straight and converge. The method further includes the steps of routing v-shaped cut-out regions that extend through the substrate, but not into the thin covering, in a substantially straight line from the left side to the right side. Angled surfaces are mitered on the top side and the bottom side. Finally, the method includes the step of folding the substrate having the thin covering about the v-shaped cut-out regions into the elongate article.

44 Claims, 12 Drawing Sheets

FIG. 8A
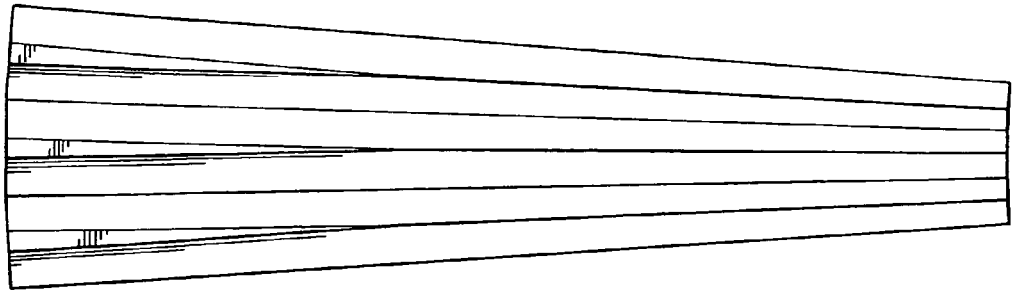
FIG. 8B
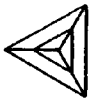
FIG. 8C
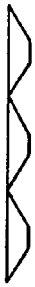
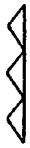
FIG. 8D
FIG. 9A
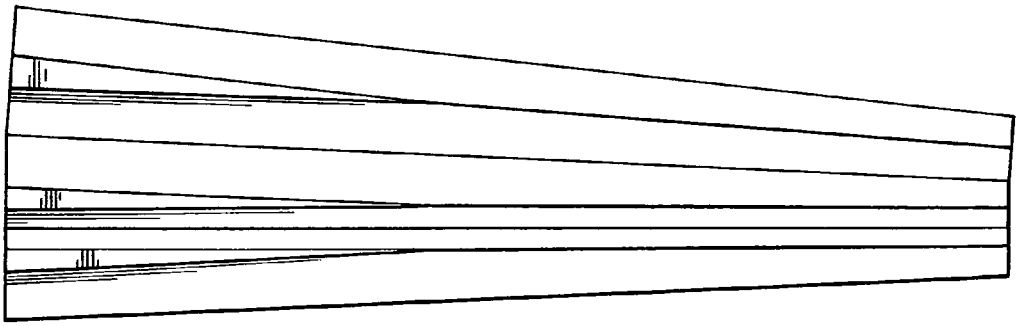
FIG. 9B
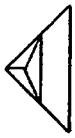
FIG. 9C
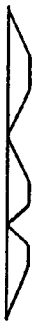
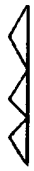
FIG. 9D FIG. 10A
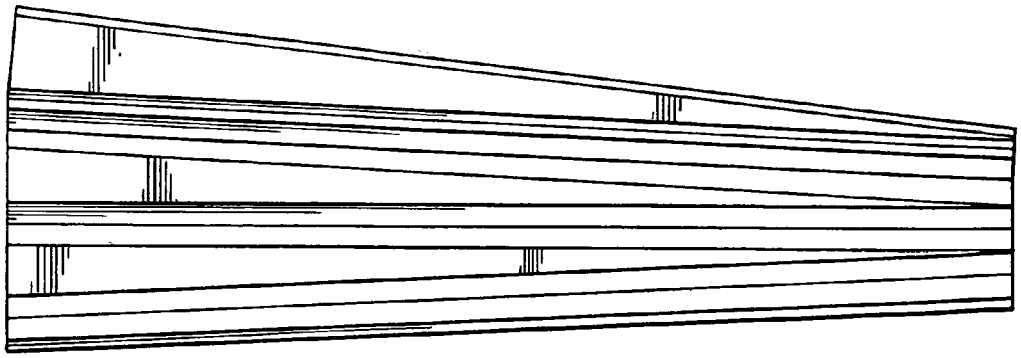
FIG. 10B
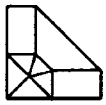
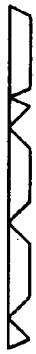
FIG. 10C
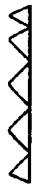
FIG. 10D
FIG. 11A
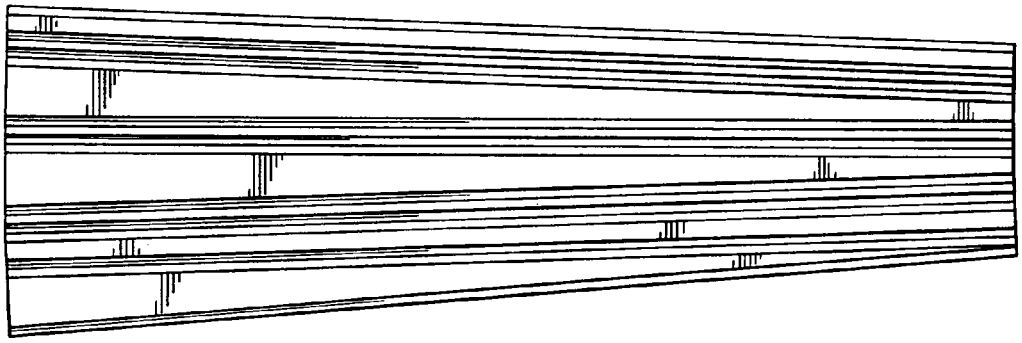
FIG. 11C
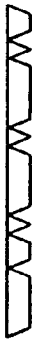
FIG. 11B
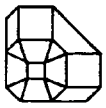
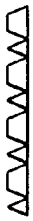
FIG. 11D FIG. 12A
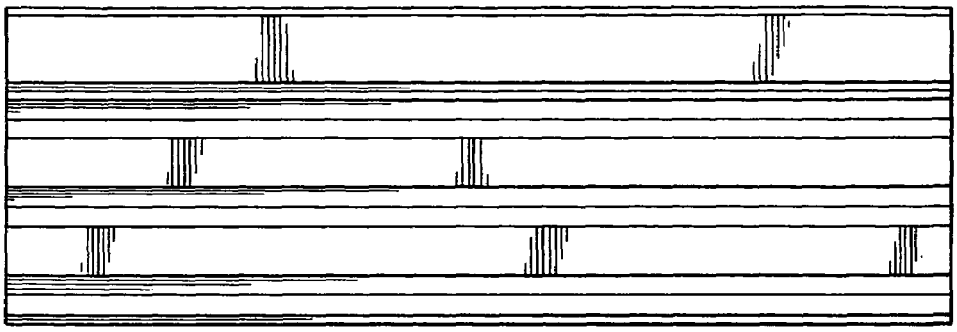
FIG. 12B
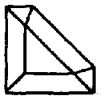
FIG. 12C
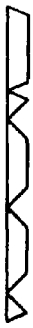
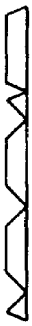
FIG. 12D
FIG. 13A
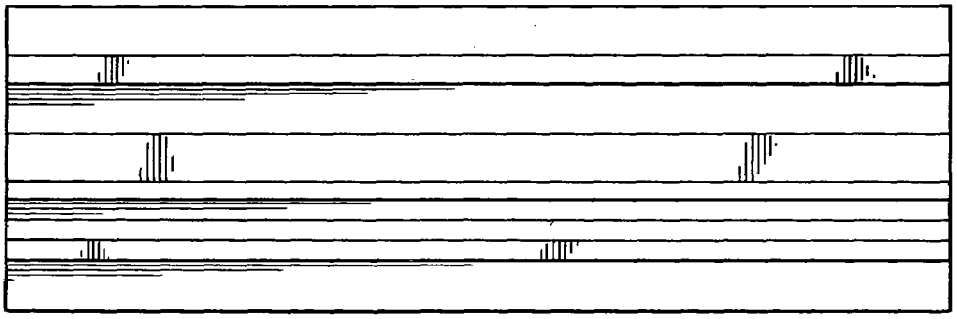
FIG. 13B
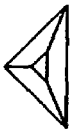
FIG. 13C
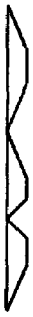
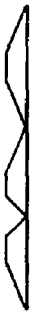
FIG. 13D FIG. 14A
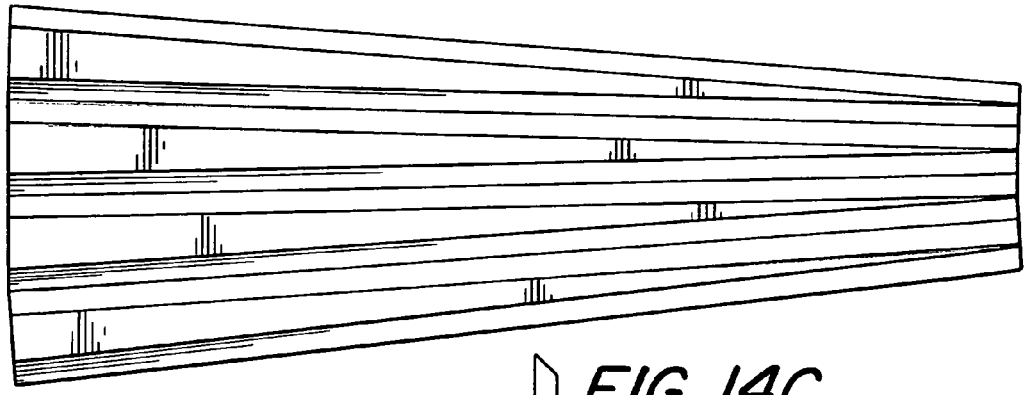
FIG. 14C
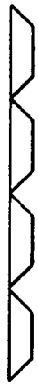
FIG. 14B
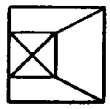
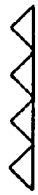
FIG. 14D
FIG. 15A
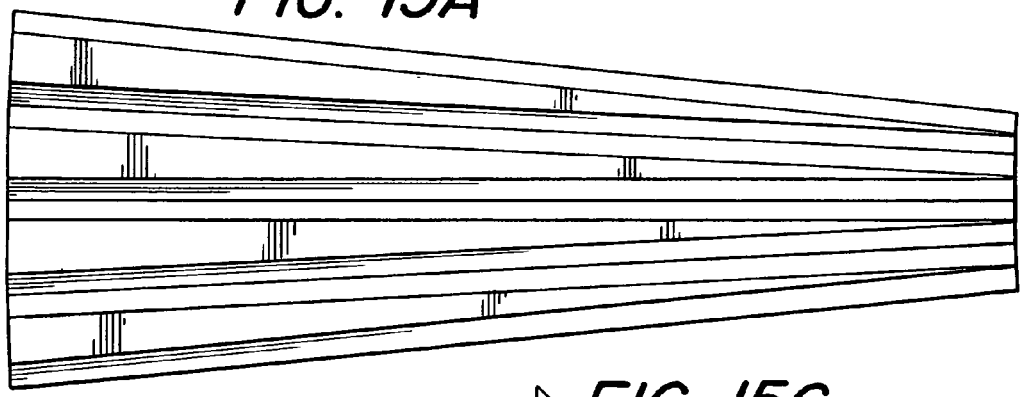
FIG. 15C
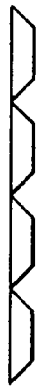
FIG. 15B
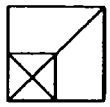
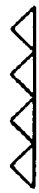
FIG. 15D FIG. 16A
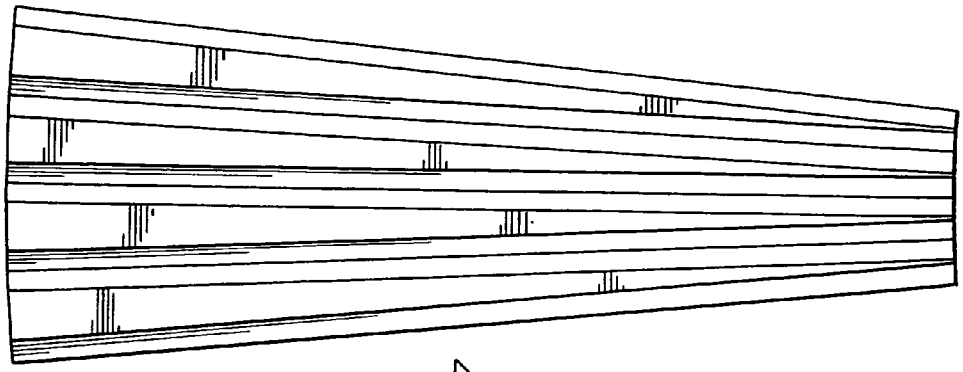
FIG. 16C
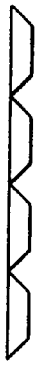
FIG. 16B
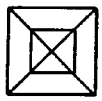
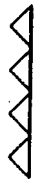
FIG. 16D
FIG. 17A
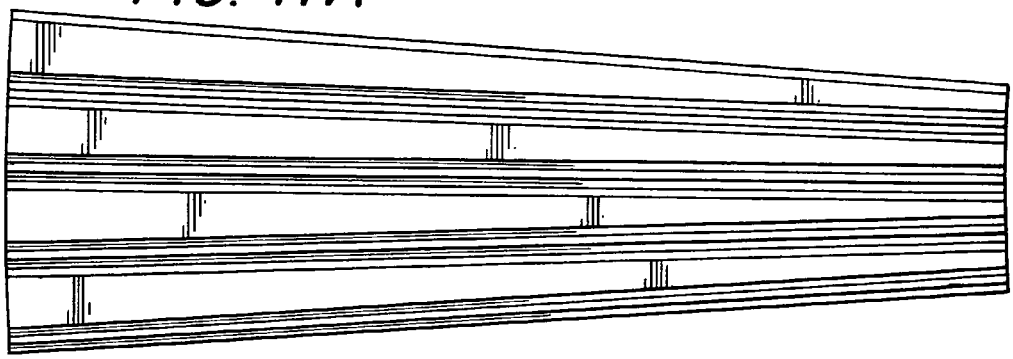
FIG. 17C
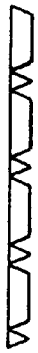
FIG. 17D
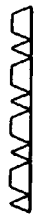
FIG. 17B
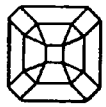

FIG. 18A
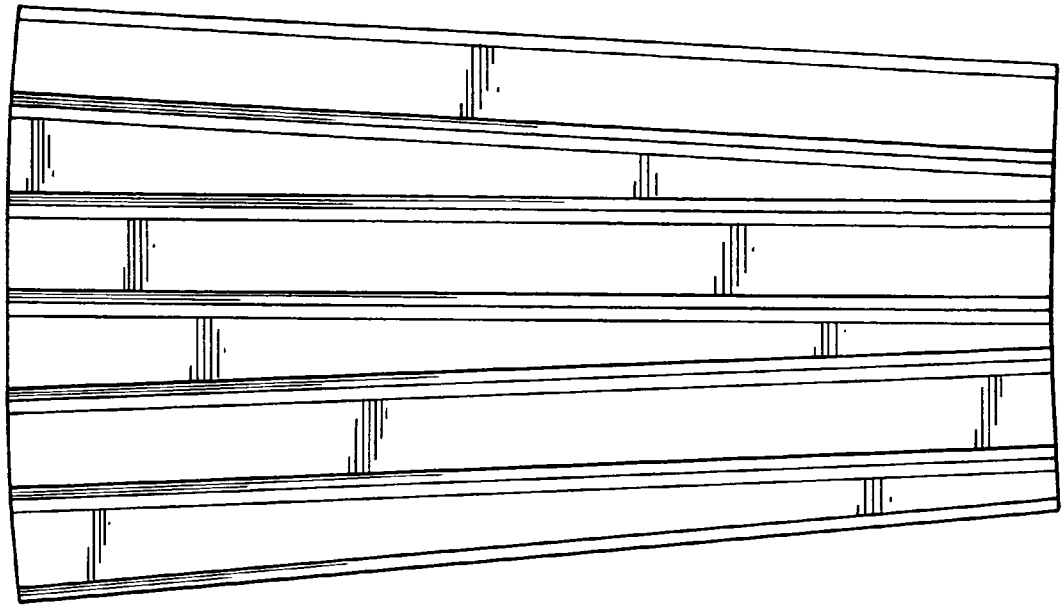
FIG. 18C
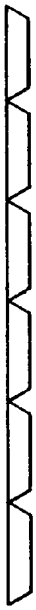
FIG. 18B
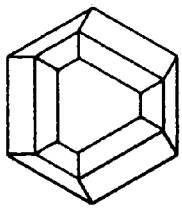
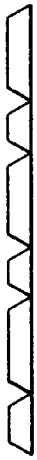
FIG. 18D

FIG. 19A
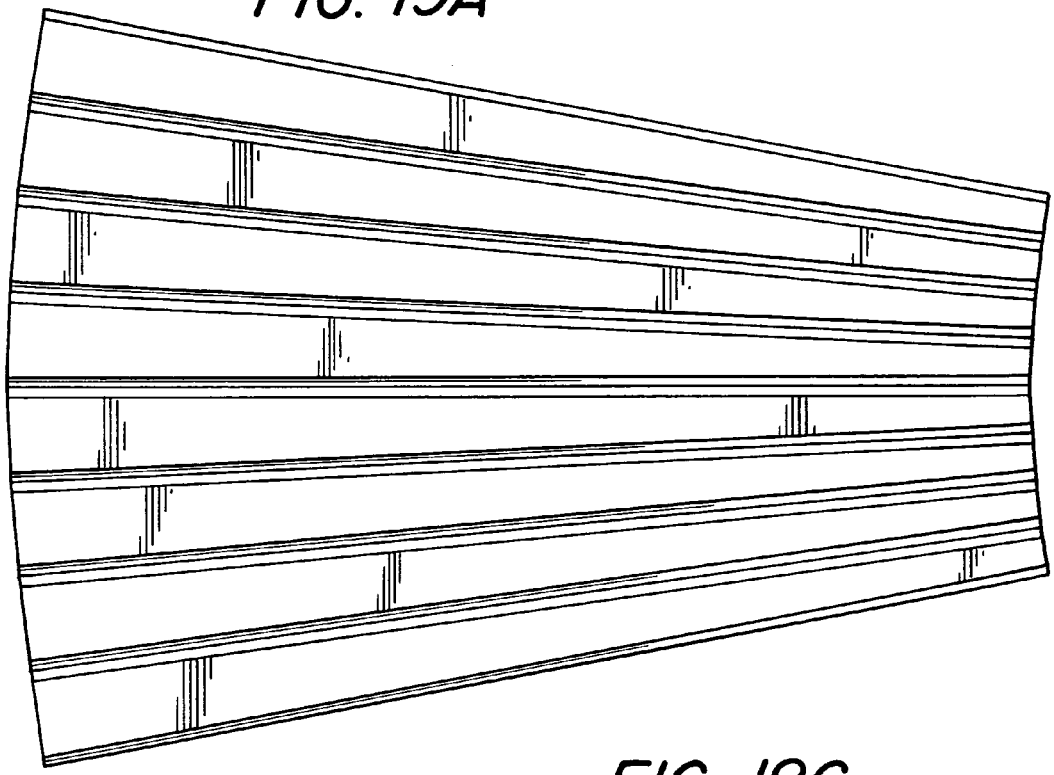
FIG. 19C
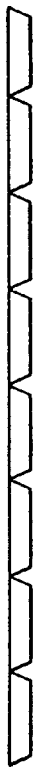
FIG. 19B
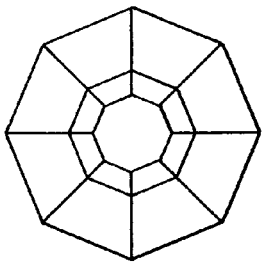
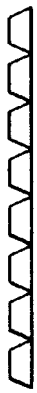
FIG. 19D

FIG. 21A
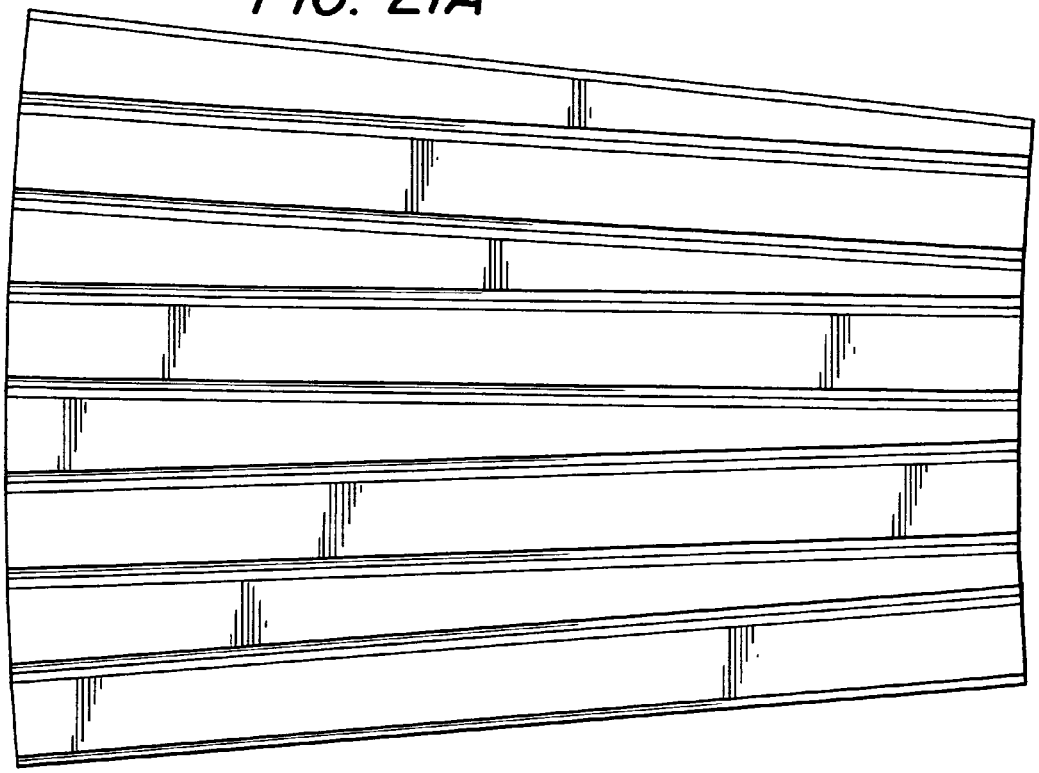
FIG. 21C
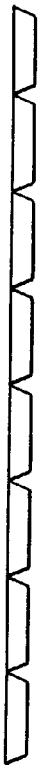
FIG. 21B
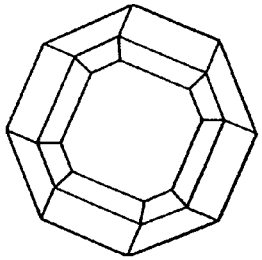
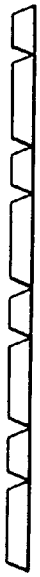
FIG. 21D

TAPERED FURNITURE LEG AND METHOD OF MAKING THE SAME

CROSS-REFERENCE TO RELATED APPLICATION

This application claims priority to U.S. Provisional Patent Application No. 60/370,845, filed Apr. 8, 2002, entitled Composite, Tapered Furniture Leg and Method of Making the Same.

BACKGROUND OF THE INVENTION

The present invention is directed to a furniture leg and, more particularly, to a unique construction of an inexpensive, tapered furniture leg.

The use of a laminated or clad substrate has long been known in the construction of elongate articles. For purpose of the present invention, "leg" and "elongate article" are used interchangeably for any elongate article. For example, U.S. Pat. No. 3,654,053 (Toedter) is directed to a decorative panel, plate, or board in which a laminated sheet blank is used and wherein v-shaped grooves are cut through a backing sheet, such as composition board, over which a film is adhered. The article is then folded into, for example, a rectangular cross-sectional configuration, as shown in FIG. 10 of this patent.

U.S. Pat. No. 1,133,106 (Cuppett) discloses veneered reinforced woodwork for furniture in which v-shaped grooves are cut into a core over which the veneer is placed. The grooves allow the article to be folded to form the corners of the article.

U.S. Pat. No. 3,911,554 (Ford) is directed to a method of bending a building panel along a selected line to provide a corner having a smooth bending edge. A foam core has a facing sheet attached thereto. V-shaped grooves are cut into the foam core allowing the article to be folded at the grooves.

U.S. Pat. No. 4,402,170 (Seidner) is directed to a millwork building construction member of rabbeted construction, such as a doorjamb, which includes a core to which a thin, bendable exterior skin is bonded. The core may be composition board that is folded after v-shaped grooves have been cut. The skin is wrapped around the folded core to form the exterior surface of the member. The skin may be wood veneer.

The use of a substrate having a thin skin or veneer that is folded to form a final article typically substantially decreases the costs of manufacturing such an article for several reasons. First, an inexpensive substrate such as flake board may be used. This substrate may be substantially thinner than the material to use a standard design tapered leg. Additionally, a thin covering or veneer of a relatively expensive material may be used. Here, there is substantially less use of the relatively expensive materials for the thin covering. Where no skin or veneer is used, a folded product that uses a relatively thin substrate as compared to the final formed article may allow for use of a greater variety of materials and may also reduce cost.

All references cited herein are incorporated herein by reference in their entireties.

BRIEF SUMMARY OF THE INVENTION

A method of fabricating an elongate article is provided which includes the steps of providing a substrate having a thin covering adhered to a top surface of the substrate and routing the substrate and thin covering to provide an outer peripheral configuration having a top side, a bottom side, a left side, and a right side, wherein the top side and the bottom side are each generally straight and converge toward one another from the left side to the right side such that the left side of the outer peripheral configuration is relatively wide as compared to the right side of the outer peripheral configuration. The method further includes the steps of routing a plurality of v-shaped cut-out regions in the substrate where each v-shaped cut-out region extends substantially through the substrate, but not into the thin covering and each v-shaped cut-out region extends in a substantially straight line from the left side to the right side of the outer peripheral configuration. The method further includes the steps of mitering an angled surface on the top side and the bottom side, extending from the top surface to the bottom surface where the angled surfaces angle inwardly from the top surface to the bottom surface. Finally, the method includes the step of folding the substrate having the thin covering about the v-shaped cut-out regions into the elongate article.

Preferably, the method of the fabricating elongate article is a method of fabricating a furniture leg. The substrate may be, for example, a flake board substrate, a wood substrate, a wood fabricate substrate, Corian, or other machinable materials. The thin covering may be, for example, a vinyl covering, a wood veneer covering, or may be other materials, such as paper, cloth, metal, and the like.

In one preferred embodiment having a square cross-sectional configuration, the step of routing the plurality of v-shaped cut-out regions includes routing first, second, and third ninety degree v-shaped cut-out regions.

The method may further include the step of bonding the substrate into the final tapered article after the step of folding.

A method of fabricating an elongate article in accordance with a more specific embodiment is also provided which includes the step of providing a substrate of a generally uniform thickness where the substrate has a top surface, a bottom surface, a left side, a right side, a top side, and a bottom side. Here, the substrate has a thin covering adhered to a top surface of the substrate. The method further includes the steps of routing the left side, right side, top side and bottom side of the substrate to provide an outer peripheral configuration having a top side, a bottom side, a left side, and a right side. The top side and the bottom side of the outer peripheral configuration each are generally straight and converge toward one another from the left side to the right side of the outer peripheral configuration such that the left side of the peripheral configuration is relatively wide as compared to the right side of the peripheral configuration. The right side of the peripheral configuration comprises a first, a second, a third and a fourth straight right side segment, each angled slightly with respect to one another. The first and second straight right side segments come together at a first right side point, the second and third right side segments come together at a second right side point, and the third and fourth right side segments come together at a third right side point. The left side of the peripheral configuration comprises a first, a second, a third and a fourth straight left side segment, each angled slightly with respect to one another. The first and second straight left side segments come together at a first left side point, the second and third left side segments come together at a second left side point, and the third and fourth left side segments come together at a third left side point. The method further includes the steps of mitering first, second and third v-shaped cut-out regions in the bottom surface of the substrate, each v-shaped cut-out region extending substantially through the substrate, but not into the thin covering and each extending in a substantially straight line (from the first left side point to the first right side point, second left side point to the second right side point, or third left side point to the third right side point, respectively). The method further includes the steps of mitering an angled surface on the top side and the bottom side of the substrate, extending from the top surface to the bottom surface. The angled surfaces angle inwardly from the top surface to the bottom surface at an angle approximately 45 degrees to the top surface and bottom surface. Finally, the method includes the step of folding the substrate having the thin covering about the first v-shaped cut-out region, second v-shaped cut-out region, and third v-shaped cut-out region into the elongate article.

The step of mitering the first, second and third v-shaped cut-out regions may include mitering first, second, and third ninety degree v-shaped cut-out regions. The step of bonding the substrate having the thin covering into the final tapered article after the step of folding may be included.

At least one additional v-shaped cut-out region may be included, at least one additional right side and left side segments, and at least one additional left side and right side points may be included to form a tapered leg having at least five sides.

The present invention is also directed to an elongate article is also provided which includes a substrate having a thin covering adhered to a top surface of the substrate. The substrate having the thin covering includes an outer peripheral configuration having a top side, a bottom side, a left side, and a right side. The top side and the bottom side are each generally straight and converge toward one another from the left side to the right side such that the left side of the outer peripheral configuration is relatively wide as compared to the right side of the outer peripheral configuration. A plurality of v-shaped cut-out regions is provided in the substrate where each v-shaped cut-out region extends substantially through the substrate, but not into the thin covering. Each v-shaped cut-out region extends in a substantially straight line from the left side to the right side of the outer peripheral configuration. An angled surface on each of the top side and the bottom side extends from the top surface to the bottom surface. The angled surfaces angle inwardly from the top surface to the bottom surface at an angle.

The elongate article may including first, second, and third ninety degree v-shaped cut-out regions. Bonding the substrate having the thin covering into the final tapered article may be included.

In a more specific embodiment of the present invention, an elongate article is provided which includes a substrate of a generally uniform thickness where the substrate has a thin covering adhered to a top surface of the substrate. The substrate having a thin covering has a top surface, a bottom surface, a left side, a right side, a top side, and a bottom side. The substrate having the thin covering has an outer peripheral configuration having a left side, right side, top side and bottom side, wherein the top side and the bottom side of the outer peripheral configuration each are generally straight and converge toward one another from the left side to the right side of the peripheral configuration such that the left side of the peripheral configuration is relatively wide as compared to the right side of the peripheral configuration. The right side of the peripheral configuration includes a first, a second, a third and a fourth straight right side segment, each angled slightly with respect to one another. The first and second straight right side segment come together at a first right side point, the second and third right side segment come together at a second right side point, and the third and fourth right side segment come together at a third right side point. The left side of the peripheral configuration comprises a first, a second, a third and a fourth straight left side segment, each angled slightly with respect to one another. The first and second straight left side segment come together at a first left side point, the second and third left side segment come together at a second left side point, and the third and fourth left side segment come together at a third left side point. First, second, and third v-shaped cut-out regions in the bottom surface of the substrate, having the thin covering extend substantially through the substrate, but not into the thin covering. The v-shaped cut-out regions extend in a substantially straight line from the first left side point to the first right side point. An angled surface on each of the top side and bottom side of the substrate having the thin covering extends from the top surface to the bottom surface of the substrate having the thin covering where the angled surfaces angle inwardly from the top surface to the bottom surface at an angle approximately 45 degrees to the top surface and bottom surface. When the substrate having the thin covering is folded about the first v-shaped cut-out region, second v-shaped cut-out region, and third v-shaped cut-out region, the elongate article is formed.

The first, second and third v-shaped cut-out regions may be 90 degree v-shaped cut-out regions.

At least one additional v-shaped cut-out region, at least one additional right side and left side segments, and at least one additional left side and right side points may be included to form a tapered leg having at least five sides.

An alternate method of fabricating an elongate article is provided which includes the steps of providing a substrate, applying tape to the top surface of the substrate, and routing the substrate to provide an outer peripheral configuration having a top side, a bottom side, a left side, and a right side. The top side and the bottom side are each generally straight and converge toward one another from the left side to the right side such that the left side of the outer peripheral configuration is relatively wide as compared to the right side of the outer peripheral configuration. A step of routing a plurality of v-shaped cut-out regions in the substrate is performed where each v-shaped cut-out region extends substantially through the substrate to the tape, but not through the tape. Each v-shaped cut-out region extends in a substantially straight line from the left side to the right side of the outer peripheral configuration. The method further includes the steps of mitering an angled surface on the top side and the bottom side extending from the top surface to the bottom surface. The angled surfaces angle inwardly from the top surface to the bottom surface at an angle. Finally, the method includes the steps of folding the substrate about the plurality of v-shaped cut-out regions, into the elongate article and removing the tape.

The substrate may be a laminate having a skin. The skin may be a thin covering material, for example, a veneer or a plastic laminate. The step of applying tape to the top surface of the substrate may include applying the tape directly over the v-shaped cut-out regions. Bonding the substrate into the final tapered article may be included.

Finally, in a more specific embodiment of the present invention, an elongate article is provided which includes a substrate having an outer peripheral configuration having a top side, a bottom side, a left side, and a right side. The top side and the bottom side are each generally straight and converge toward one another from the left side to the right side such that the left side of the outer peripheral configuration is relatively wide as compared to the right side of the outer peripheral configuration. A plurality of v-shaped cut-out regions is provided in the substrate, each v-shaped cut-out region extending substantially through the substrate and each v-shaped cut-out region extending in a substantially straight line from the left side to the right side of the outer peripheral configuration. An angled surface on each of the top side and the bottom side extends from the top surface to the bottom surface. The angled surfaces angle inwardly from the top surface to the bottom surface at an angle.

The substrate may be a laminate having a skin. The skin may be a thin covering material of, for example, veneers and plastic laminates.

BRIEF DESCRIPTION OF SEVERAL VIEWS OF THE DRAWINGS

The invention will be described in conjunction with the following drawings in which like reference numerals designate like elements and wherein:

FIG. 8A is a bottom view of a substrate having a thin covering for a three-sided tapered isosceles triangle furniture leg constructed in accordance with the present invention;

FIG. 8B is a top view of a folded leg using the substrate having a thin covering of FIG. 8A;

FIG. 8C is a simplified left side view of the substrate of FIG. 8A;

FIG. 8D is a simplified right side view of the substrate of FIG. 8A;

FIG. 9A is a bottom view of a substrate having a thin covering for a right angle triangle furniture leg constructed in accordance with the present invention;

FIG. 9B is a top view of a folded leg using the substrate having a thin covering of FIG. 9A;

FIG. 9C is a simplified left side view of the substrate of FIG. 9A;

FIG. 9D is a simplified right side view of the substrate of FIG. 9A;

FIG. 10A is a bottom view of a substrate having a thin covering for a five sided tapered furniture leg constructed in accordance with the present invention;

FIG. 10B is a top view of a folded leg using the substrate having a thin covering of FIG. 10A;

FIG. 10C is a simplified left side view of the substrate of FIG. 10A;

FIG. 10D is a simplified right side view of the substrate of FIG. 10A;

FIG. 11A is a bottom view of a substrate having a thin covering for an eight-sided tapered furniture leg having chamfered corners constructed in accordance with the present invention;

FIG. 11B is a top view of a folded leg using the substrate having a thin covering of FIG. 11A;

FIG. 11C is a simplified left side view of the substrate of FIG. 11A;

FIG. 11D is a simplified right side view of the substrate of FIG. 11A;

FIG. 12A is a bottom view of a substrate having a thin covering for a five sided straight furniture leg constructed in accordance with the present invention;

FIG. 12B is a top view of a folded leg using the substrate having a thin covering of FIG. 12A;

FIG. 12C is a simplified left side view of the substrate of FIG. 12A;

FIG. 12D is a simplified right side view of the substrate of FIG. 12A;

FIG. 13A is a bottom view of a substrate having a thin covering for a three sided right angle triangle furniture leg constructed in accordance with the present invention;

FIG. 13B is a top view of a folded leg using the substrate having a thin covering of FIG. 13A;

FIG. 13C is a simplified left side view of the substrate of FIG. 13A;

FIG. 13D is a simplified right side view of the substrate of FIG. 13A;

FIG. 14A is a bottom view of a substrate having a thin covering for a four sided furniture leg having three tapered sides constructed in accordance with the present invention;

FIG. 14B is a top view of a folded leg using the substrate having a thin covering of FIG.14A;

FIG. 14C is a simplified left side view of the substrate of FIG. 14A;

FIG. 14D is a simplified right side view of the substrate of FIG. 14A;

FIG. 15A is a bottom view of a substrate having a thin covering for a four sided furniture leg having three tapered sides constructed in accordance with the present invention;

FIG. 15B is a top view of a folded leg using the substrate having a thin covering of FIG. 15A;

FIG. 15C is a simplified left side view of the substrate of FIG. 15A;

FIG. 15D is a simplified right side view of the substrate of FIG. 15A;

FIG. 16A is a bottom view of a substrate having a thin covering for a four sided furniture leg with four tapered sides constructed in accordance with the present invention;

FIG. 16B is a top view of a folded leg using the substrate having a thin covering of FIG. 16A;

FIG. 16C is a simplified left side view of the substrate of FIG. 16A;

FIG. 16D is a simplified right side view of the substrate of FIG. 16A;

FIG. 17A is a bottom view of a substrate having a thin covering for an eight sided furniture leg (having chamfered corners) constructed in accordance with the present invention;

FIG. 17B is a top view of a folded leg using the substrate having a thin covering of FIG. 17A;

FIG. 17C is a simplified left side view of the substrate of FIG. 17A;

FIG. 17D is a simplified right side view of the substrate of FIG. 17A;

FIG. 18A is a bottom view of a substrate having a thin covering for a hexagonal furniture leg having alternating tapered and straight sides constructed in accordance with the present invention;

FIG. 18B is a top view of a folded leg using the substrate having a thin covering of FIG. 18A;

FIG. 18C is a simplified left side view of the substrate of FIG. 18A;

FIG. 18D is a simplified right side view of the substrate of FIG. 18A;

FIG. 19A is a bottom view of a substrate having a thin covering for an octagonal tapered furniture leg constructed in accordance with the present invention;

FIG. 19B is a top view of a folded leg using the substrate having a thin covering of FIG. 19A;

FIG. 19C is a simplified left side view of the substrate of FIG. 19A;

FIG. 19D is a simplified right side view of the substrate of FIG. 19A;

FIG. 20A is a bottom view of a substrate having a thin covering for a hexagonal tapered furniture leg constructed in accordance with the present invention;

FIG. 20B is a top view of a folded leg using the substrate having a thin covering of FIG. 20A;

FIG. 20C is a simplified left side view of the substrate of FIG. 20A;

FIG. 21A is a bottom view of a substrate having a thin covering for an octagonal tapered furniture leg having alternating straight and tapered sides constructed in accordance with the present invention;

FIG. 21B is a top view of a folded leg using the substrate having a thin covering of FIG. 21A;

FIG. 21C is a simplified left side view of the substrate of FIG. 21A; and FIG. 21D is a simplified right side view of the substrate of FIG. 21A.

DETAILED DESCRIPTION OF THE INVENTION

The invention will be illustrated in more detail with reference to the following embodiments, but it should be understood that the present invention is not deemed to be limited thereto.

Figure 1:
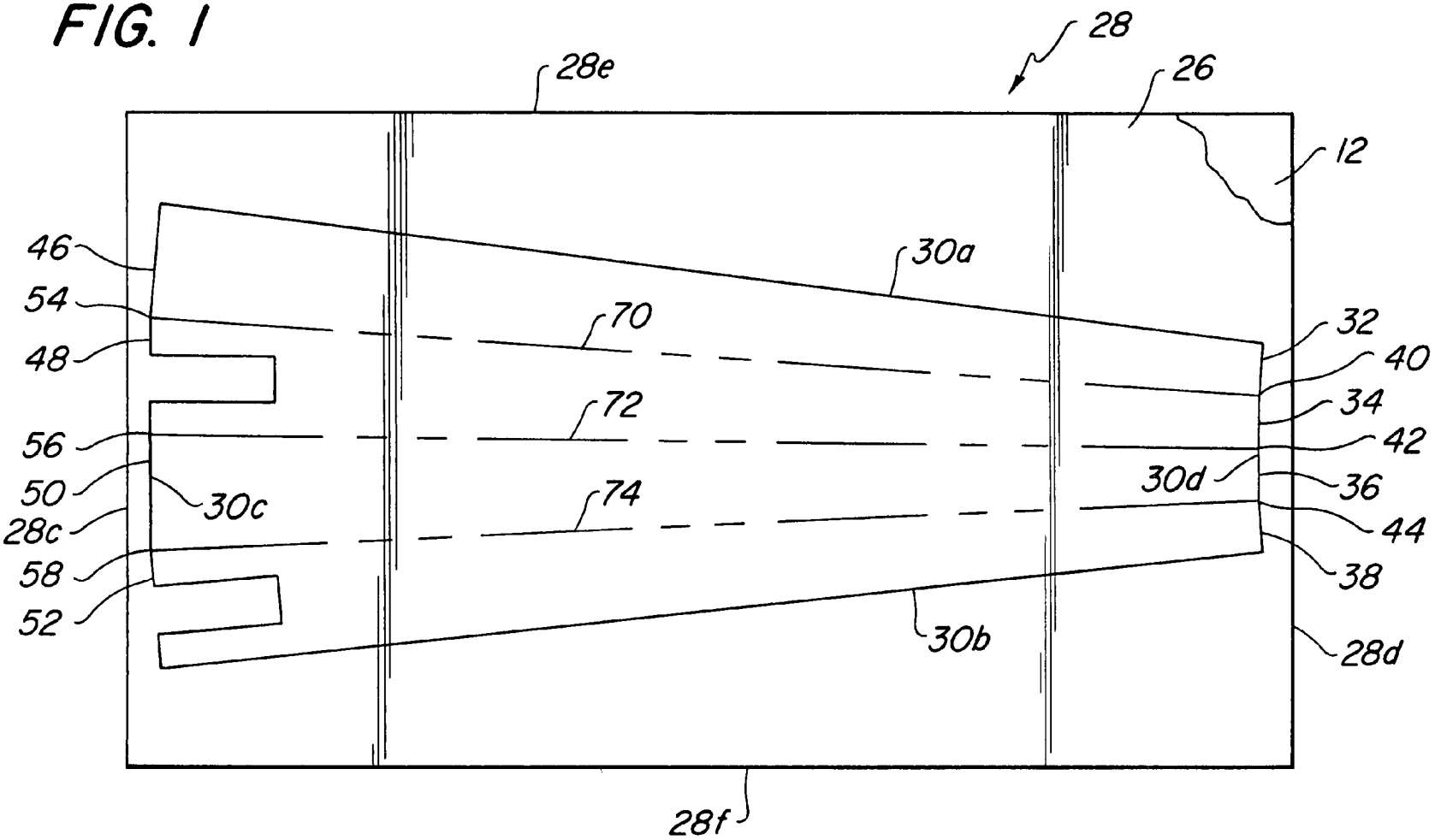
FIG. 1 is a partially cut away, top plan view of a substrate having a thin covering for use in forming a tapered furniture leg, depicting a pattern for forming the leg, in accordance with one preferred embodiment of the present invention.
Figure 2:
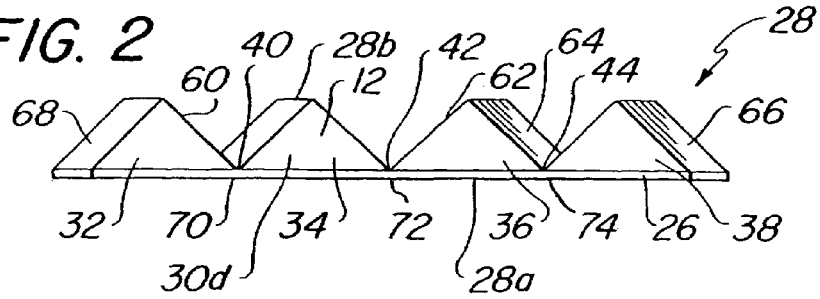
FIG. 2 is a right side view of the substrate having a thin covering of FIG. 1, shown subsequent to routing and mitering, for forming the tapered furniture leg.
Figure 3:
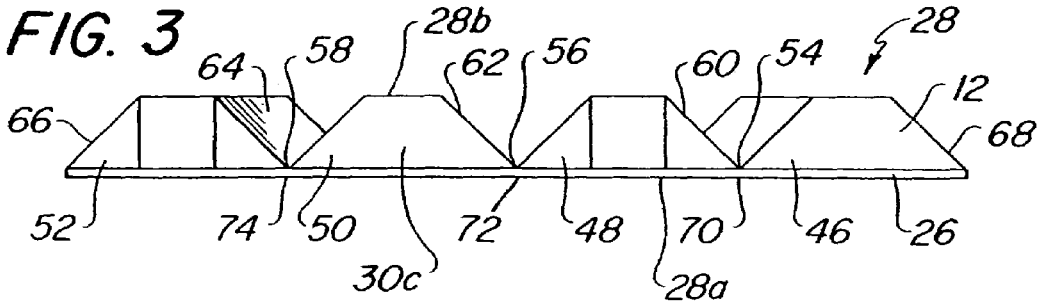
FIG. 3 is a left side view of the substrate having a thin covering of FIG. 2.
Figure 4:
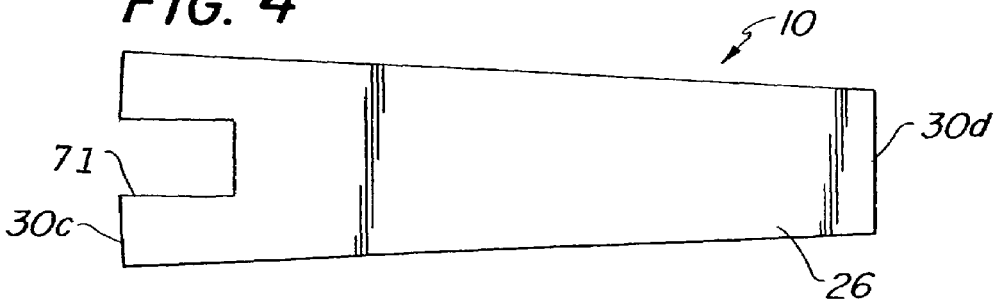
FIG. 4. is a side view of a tapered furniture leg constructed from the substrate having a thin covering of FIG. 2, depicted in its finished, folded configuration.
Figure 5:
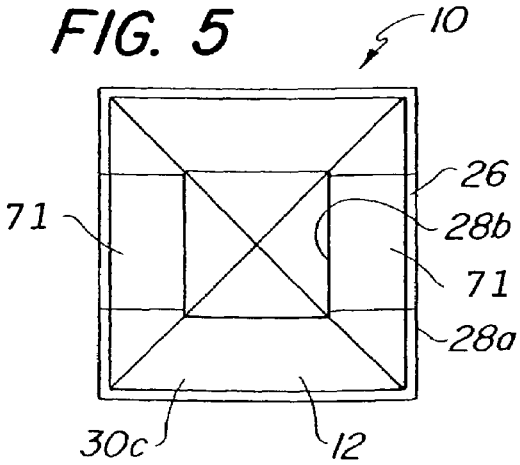
FIG. 5 is top view of the tapered furniture leg of FIG. 4.
Figure 6:
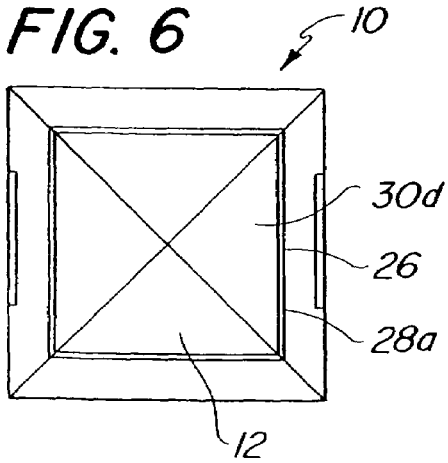
FIG. 6 is bottom view of the tapered furniture leg of FIG. 4.

Referring now to the drawings, wherein like part numbers refer to like elements throughout the several views, there is shown in FIGS. 1–3 a substrate having a thin covering 28, constructed from the substrate 12 and the thin outer covering 26 (see FIGS. 2–3), used to form the tapered furniture leg 10 of one preferred embodiment of the present invention. An example of a finished tapered furniture leg 10 is depicted in FIGS. 4–6.

The tapered furniture leg 10 (or other conceivable elongate article) is constructed in accordance with following method. First, the substrate 12 is provided which is of a generally uniform thickness and which is typically rectangular in cross-sectional shape. For purposes of the present invention, the term "substrate" is intended to broadly include any material of a thickness that can be machined, for example, with conventional tooling. Medium density fiberboard (MDF) is particularly suitable due to its low cost. In addition to MDF, any type of wood or wood-based product (e.g., low density fiberboard, high density fiberboard, flakeboard, plywood), or suitable polymeric material, for example, Corian, and the like, would also perform satisfactorily. Essentially, the present invention would operate properly on a substrate of substantially any machinable material available in an appropriate size. In the preferred embodiment, the thin covering 26 is adhered to a surface of the substrate 12 to form the substrate having a thin covering 28. The thin covering 26 may be any thin covering, but is preferably a vinyl covering, a wood veneer covering, a plastic laminate, sheet metal, paper or the like. The substrate having a thin covering 28 has a top surface 28*a* (i.e., the outer surface of the thin covering 26), a bottom surface 28*b*, a left side 28*c*, a right side 28*d*, a top side 28*e*, and a bottom side 28*f*.

As shown in FIG. 1, the sides of the substrate having a thin covering, including its left side 28*c*, right side 28*d*, top side 28*e* and bottom side 28*f*, are then routed to provide an outer peripheral configuration, including outer peripheral configuration top side 30*a*, bottom side 30*b*, left side 30*c* and right side 30*d* as follows. For example, a Morbidelli computerized router may be used. The top side 28*e* and the bottom side 28*f* of the substrate having a thin covering 28 are routed in generally straight lines to form peripheral configuration top side 30*a* and bottom side 30*b*. Peripheral configuration top side 30*a* and bottom side 30*b* converge toward one another from the left side 28*c* of the substrate having a thin covering 28 to the right side 28*d* of the substrate having a thin covering 28. Peripheral configuration left side 30*c* and right side 30*d* are routed, as described below, such that peripheral configuration left side 30*c* is relatively wide as compared to peripheral configuration right side 30*d*. The peripheral configuration right side 30*d* comprises a first 32, a second 34, a third 36 and a fourth 38 straight right side segment, each angled slightly with respect to one another (and of a like length for the square cross-sectional configuration of the present embodiment). The first 32 and second straight 34 right side segments come together at a first right side point 40. The second 34 and third 36 right side segments come together at a second right side point 42. Finally, the third 36 and fourth 38 right side segments come together at a third right side point 44. The peripheral configuration left side 30*c* includes a first 46, a second 48, a third 50 and a fourth 52 straight left side segment, each angled slightly with respect to one another and, if a square cross-sectional shape is desired, of a like length. If a rectangular cross-sectional shape for the leg is desired, first straight side segment and third straight side segment are of equal length and second straight side segment and fourth straight side segment are of equal length, different than that of the first and third straight side segments.

The first 46 and second 48 straight left side segments come together at a first left side point 54. The second 48 and third 50 left side segments come together at a second left side point 56, and the third 50 and fourth 52 left side segments come together at a third left side point 58.

A first v-shaped cut-out region 60, preferably a ninety degree cut-out, is mitered in the bottom surface 28*b* of the substrate having a thin covering 28, where the first v-shaped cut-out region 60 extends substantially through the substrate 28, but not into the thin covering 26. For example, a Star V-groove mitering machine may be used. The first v-shaped cut-out region 60 extends in a substantially straight line from the first left side point 54 to the first right side point 40. A fold-line 70 is formed.

A second v-shaped cut-out region 62, preferably a 90 degree cut-out, is mitered in the bottom surface 28*b* of the substrate having a thin covering 28, where the second v-shaped cut-out region 62 extends substantially through the substrate 12, but not into the thin covering 26. The second v-shaped cut-out region 62 extends in a substantially straight line from the second left side point 56 to the second right side point 42. A second fold-line 72 is formed.

Finally, a third v-shaped cut-out region 64, preferably a 90 degree cut-out, is mitered in the bottom surface 28*b* of the substrate having a thin covering 28, where the third v-shaped cut-out region 64 extends substantially through the substrate 12, but not into the thin covering 26. The third v-shaped cut-out region 64 extends in a substantially straight line from the third left side point 58 to the third right side point 44. A third fold-line 74 is formed.

Along the peripheral configuration top side 30*a* and bottom side 30*b*, an angled surface 66, 68 is mitered through the substrate having a thin covering 28 from the top surface 28*a* to the bottom surface 28*b* of the substrate having a thin covering 28. The angled surfaces 66, 68 angle inwardly from the top surface 28*a* to the bottom surface 28*b* at an angle approximately 45 degrees (for a square or rectangular cross-sectional leg) to each of the top surface 28*a* and bottom surface 28*b*.

Finally, the substrate having a thin covering 28 is folded about the fold-lines 70, 72, 74 formed by the first v-shaped cut-out region 60, second v-shaped cut-out region 62, and third v-shaped cut-out region 64 into the tapered furniture leg 10, i.e., the elongate article.

Once the steps above are accomplished, the leg 10 may be bonded, using, for example, hot melt adhesive, cold glue, and the like. The leg 10 may otherwise be secured using a variety of other fasteners, for example, nails, screws, staples, and the like. A cut-out 71 or similar feature may be formed for mounting the leg 10.

Figure 7A:
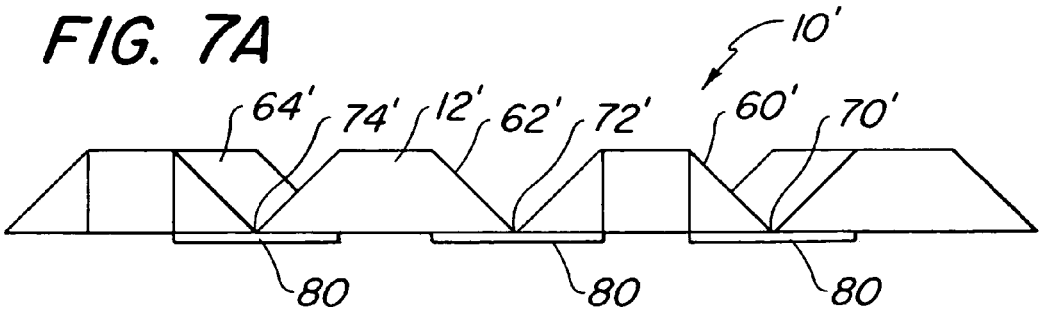
FIG. 7A is a left side view of an alternate embodiment of a substrate, wherein the substrate has a covering in the form of strips of tape.

In an alternate embodiment of the present invention, the "thin covering" of the present invention may be in the form of a removable tape, for example, removable strips of tape. As can be seen in FIG. 7A, which shows a substrate 12', the thin covering is in the form of strips of tape 80 that are adjacent the v-shaped cut-out regions 60', 62', 64'. The strips of tape 80 are placed on the substrate 12' in lieu of a thin covering that covers the entire surface of the substrate. This accomplishes several goals. Similar to that described above, once the leg 10' is folded about the fold-lines 70', 72', 74' formed by the first v-shaped cut-out region 60', second v-shaped cut-out region 62', and third v-shaped cut-out region 64' into the tapered furniture leg 10', and once the leg 10' is bonded, the strips of tape 80 may be removed leaving only the substrate 12' that forms the leg 10'. Therefore, this is desirable, for example, where the substrate 12' itself forms the outer surface of the leg 10'. For example, a leg constructed using a substrate of Corian may be fabricated in this manner.

Figure 7B:
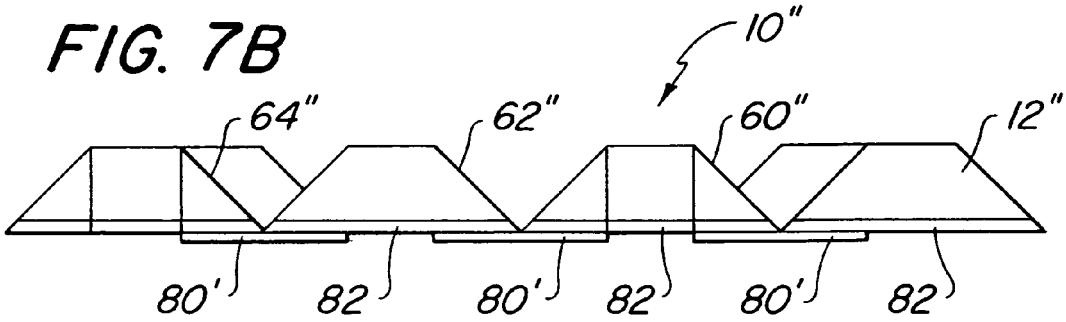
FIG. 7B is a left side view of another alternate embodiment of a substrate, wherein the substrate has a skin that covers the entire substrate and the substrate has a covering is in the form of strips of tape.
Figure 20D:
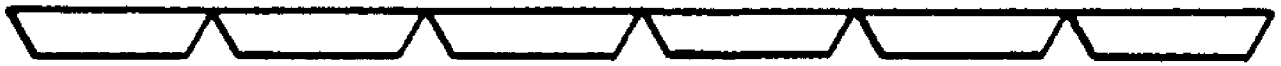
FIG. 20D is a simplified right side view of the substrate of FIG. 20A.
Figure 20D:
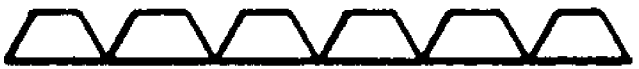

Additionally, in another similar embodiment of a leg 10" as shown in FIG. 7B, where a relatively brittle thin covering is used, a similar method of fabrication is desirable. Here, a thin skin 82 that covers the entire surface of the substrate 12" is used and, additionally, tape, for example, strips of tape 80' are used. This is desirable, for example, when a brittle material such as a wood veneer, a plastic laminate such as Formica, and the like are used. Since these materials may be too brittle to bend at sharp angles, the v-shaped cut-out regions 60", 62", 64" extend through the skin 82 that covers the entire surface of the substrate 12" to the tape 80', but not through the tape 80'. The leg 10" is folded into shape, as described above, and the tape 80' is removed. For certain brittle materials, the cut-out regions need only be made deep enough to provide for a clean fold.

As indicated above, the elongate article 10, 10', 10" of the present invention need not have a square cross-sectional shape as in the embodiments described above. For example, as shown in FIGS. 8A through 8D, a simplified substrate is shown depicting fold lines for a equilateral triangular shaped leg. One skilled in the art of woodworking with computerized routers could easily determine the appropriate geometry required. For example, in a equilateral triangle configuration, two v-shaped cut-out regions must be formed, each having a 120 degree v-shape cut-outs.

FIGS. 9A–9D through 21A–21D go on to illustrate numerous other configurations of legs formed using the method of the present invention. For example, tapered triangular-shaped legs (see FIGS. 8A–8D, and 9A–9D), square shaped legs (see FIGS. 14A–14D, 15A–15D, and 16A–16D), and tapered legs having greater than four sides (see FIGS. 10A–10D, 11A–11D, 17A–17D, 18A–18D, 19A–19D, 20A–20D, and 21A–21D). Again, one skilled in the art of woodworking with computerized routers could easily determine the appropriate geometry required for each of these embodiments.

The tapered portions of the legs do not have to be on all four sides of the legs. For example, FIGS. 9A–9D, 10A–10D, 11A–11D, 14A–14D, and 15A–15D depict legs where some surfaces are not tapered while other leg surfaces are tapered. Here, Again, one skilled in the art can easily determine the precise geometry required to form such legs by observing the figures here.

Note that FIGS. 12A–12D and 13A–13D are included herein for illustrative purposes and show a leg that has no taper. Here, the left side and the right side on each have the same dimension and all v-shaped cut-outs are parallel to one another, thereby forming a non-tapered leg.

Finally, it is noted that the thin covering of the various embodiments need not be limited to a single uniform thin covering for each leg. For example, a thin covering of a metallic material may be used on the lower half of the substrate, while a wood veneer thin covering may be used on the upper half of the substrate to yield a finished leg appearing to have a metal lower half and a wood veneer upper half.

While the invention has been described in detail and with reference to specific embodiments, it will be apparent to one skilled in the art that various changes and modifications can be made therein without departing from the spirit and scope thereof.

What is claimed is:

1. A method of fabricating an elongate article comprising the steps of:

(a) providing a substrate and a thin covering adhered to a top surface of the substrate;

(b) routing the substrate and thin covering to provide an outer peripheral configuration having a top side, a bottom side, a left side, and a right side, wherein the top side and the bottom side are each generally straight and converge toward one another from the left side to the right side such that the left side of the outer peripheral configuration is relatively wide as compared to the right side of the outer peripheral configuration;

(c) routing a plurality of v-shaped cut-out regions in the substrate, each v-shaped cut-out region extending substantially through the substrate, but not into the thin covering, each v-shaped cut-out region extending in a substantially straight line from the left side to the right side of the outer peripheral configuration;

(d) mitering an angled surface on the top side and the bottom side, extending from the top surface to a bottom surface of the substrate, the angled surfaces angling inwardly from the top surface to the bottom surface at an angle; and (e) folding the substrate having the thin covering about the plurality of v-shaped cut-out regions, into the elongate article.

2. The method of fabricating an elongate article of claim 1, wherein the method of fabricating an elongate article is a method of fabricating a furniture leg.

3. The method of fabricating an elongate article of claim 1, wherein the step including providing the substrate includes providing a flake board substrate.

4. The method of fabricating an elongate article of claim 1, wherein the step including providing the substrate includes providing a wood substrate.

5. The method of fabricating an elongate article of claim 1, wherein the step including providing the substrate includes providing a wood product substrate.

6. The method of fabricating an elongate article of claim 1, wherein the step including providing the thin covering includes providing a vinyl covering.

7. The method of fabricating an elongate article of claim 1, wherein the step including providing the thin covering includes providing a wood veneer covering.

8. The method of fabricating an elongate article of claim 1, wherein the step of routing the plurality of v-shaped cut-out regions includes routing first, second, and third ninety degree v-shaped cut-out regions.

9. The method of fabricating an elongate article of claim 1, including the step of bonding the substrate into the final tapered article after the step of folding.

10. A method of fabricating an elongate article, comprising the steps of:

(a) providing a substrate of a generally uniform thickness, the substrate having a top surface, a bottom surface, a left side, a right side, a top side, and a bottom side, the substrate having a thin covering adhered to a top surface of the substrate;

(b) routing the left side, right side, top side and bottom side of the substrate to provide an outer peripheral configuration having a top side, a bottom side, a left side, and a right side, wherein:

(i) the top side and the bottom side of the outer peripheral configuration each are generally straight and converge toward one another from the left side to the right side of the outer peripheral configuration such that the left side of the peripheral configuration is relatively wide as compared to the right side of the peripheral configuration;

(ii) the right side of the peripheral configuration comprises a first, a second, a third and a fourth straight right side segment, each angled slightly with respect to one another, the first and second straight right side segment coming together at a first right side point, the second and third right side segment coming together at a second right side point, and the third and fourth right side segment coming together at a third right side point; and (iii) the left side of the peripheral configuration comprises a first, a second, a third and a fourth straight left side segment, each angled slightly with respect to one another, the first and second straight left side segment coming together at a first left side point, the second and third left side segment coming together at a second left side point, and the third and fourth left side segment coming together at a third left side point;

(c) mitering a first v-shaped cut-out region in the bottom surface of the substrate, the v-shaped cut-out region extending substantially through the substrate, but not into the thin covering, the v-shaped cut-out region extending in a substantially straight line from the first left side point to the first right side point;

(d) mitering a second v-shaped cut-out region in the bottom surface of the substrate, the v-shaped cut-out region extending substantially through the substrate, but not into the thin covering, the v-shaped cut-out region extending in a substantially straight line from the second left side point to the second right side point;

(e) mitering a third v-shaped cut-out region in the bottom surface of the substrate, the v-shaped cut-out region extending substantially through the substrate, but not into the thin covering, the v-shaped cut-out region extending in a substantially straight line from the third left side point to the third right side point;

(f) mitering an angled surface on the top side and the bottom side of the substrate, extending from the top surface to the bottom surface, the angled surfaces angling inwardly from the top surface to the bottom surface at an angle approximately 45 degrees to the top surface and bottom surface; and (g) folding the substrate having the thin covering about the first v-shaped cut-out region, second v-shaped cut-out region, and third v-shaped cut-out region into the elongate article.

11. The method of fabricating an elongate article of claim 10, wherein the method of fabricating an elongate article is a method of fabricating a furniture leg.

12. The method of fabricating an elongate article of claim 10, wherein the step including providing the substrate includes providing a flake board substrate.

13. The method of fabricating an elongate article of claim 10, wherein the step including providing the substrate includes providing a wood substrate.

14. The method of fabricating an elongate article of claim 10, wherein the step including providing the substrate includes providing a wood product substrate.

15. The method of fabricating an elongate article of claim 10, wherein the step including providing the thin covering includes providing a vinyl covering.

16. The method of fabricating an elongate article of claim 10, wherein the step including providing the thin covering includes providing a wood veneer covering.

17. The method of fabricating an elongate article of claim 10, wherein the step of mitering the first, second and third v-shaped cut-out regions includes mitering first, second, and third ninety degree v-shaped cut-out regions.

18. The method of fabricating an elongate article of claim 10, including the step of bonding the substrate having the thin covering into the final tapered article after the step of folding.

19. The method of fabricating an elongate article of claim 10, including at least one additional v-shaped cut-out region and including at least one additional right side and left side segments, and at least one additional left side and right side points, to form a tapered leg having at least five sides.

20. An elongate article, comprising:

(a) a substrate having a thin covering adhered to a top surface of the substrate, the substrate having the thin covering comprising an outer peripheral configuration having a top side, a bottom side, a left side, and a right side, wherein the top side and the bottom side are each generally straight and converge toward one another from the left side to the right side such that the left side of the outer peripheral configuration is relatively wide as compared to the right side of the outer peripheral configuration;

(b) a plurality of v-shaped cut-out regions in the substrate, each v-shaped cut-out region extending substantially through the substrate, but not into the thin covering, each v-shaped cut-out region extending in a substantially straight line from the left side to the right side of the outer peripheral configuration; and (c) an angled surface on each of the top side and the bottom side, extending from the top surface to the bottom surface, the angled surfaces angling inwardly from the top surface to a bottom surface of the substrate at an angle.

21. The elongate article of claim 20, wherein the elongate article is a furniture leg.

22. The elongate article of claim 20, wherein the substrate is a flake board substrate.

23. The elongate article of claim 20, wherein the substrate is a wood substrate.

24. The elongate article of claim 20, wherein the substrate is a wood product substrate.

25. The elongate article of claim 20, wherein the thin covering is a vinyl covering.

26. The elongate article of claim 20, wherein the thin covering is a wood veneer covering.

27. The elongate article of claim 20, including first, second, and third ninety degree v-shaped cut-out regions.

28. The elongate article of claim 20, including a bond of the substrate having the thin covering into the final tapered article.

29. An elongate article, comprising:

(a) a substrate of a generally uniform thickness, the substrate having a thin covering adhered to a top surface of the substrate, the substrate having a thin covering having a top surface, a bottom surface, a left side, a right side, a top side, and a bottom side;

(b) the substrate having the thin covering having an outer peripheral configuration having a left side, right side, top side and bottom side, wherein (i) the top side and the bottom side of the outer peripheral configuration each are generally straight and converge toward one another from the left side to the right side of the peripheral configuration such that the left side of the peripheral configuration is relatively wide as compared to the right side of the peripheral configuration;

(ii) the right side of the peripheral configuration comprises a first, a second, a third and a fourth straight right side segment, each angled slightly with respect to one another, the first and second straight right side segment coming together at a first right side point, the second and third right side segment coming together at a second right side point, and the third and fourth right side segment coming together at a third right side point;

(iii) the left side of the peripheral configuration comprises a first, a second, a third and a fourth straight left side segment, each angled slightly with respect to one another, the first and second straight left side segment coming together at a first left side point, the second and third left side segment coming together at a second left side point, and the third and fourth left side segment coming together at a third left side point;

(c) a first v-shaped cut-out region in the bottom surface of the substrate having the thin covering, the v-shaped cut-out region extending substantially through the substrate, but not into the thin covering, the v-shaped cut-out region extending in a substantially straight line from the first left side point to the first right side point;

(d) a second v-shaped cut-out region in the bottom surface of the substrate having the thin covering, the v-shaped cut-out region extending substantially through the substrate, but not into the thin covering, the v-shaped cut-out region extending in a substantially straight line from the second left side point to the second right side point;

(e) a third v-shaped cut-out region in the bottom surface of the substrate having the thin covering, the v-shaped cut-out region extending substantially through the substrate, but not into the thin covering, the v-shaped cut-out region extending in a substantially straight line from the third left side point to the third right side point; and (f) an angled surface on each of the top side and bottom side of the substrate having the thin covering, extending from the top surface to the bottom surface of the substrate having the thin covering, the angled surfaces angling inwardly from the top surface to the bottom surface at an angle approximately 45 degrees to the top surface and bottom surface;

whereby, when the substrate having the thin covering is folded about the first v-shaped cut-out region, second v-shaped cut-out region, and third v-shaped cut-out region, elongate article is formed.

30. The elongate article of claim 29, wherein the substrate is flake board.

31. The elongate article of claim 29, wherein the substrate is wood.

32. The elongate article of claim 29, wherein the substrate is a wood product.

33. The elongate article of claim 29, wherein the thin covering is a vinyl covering.

34. The elongate article of claim 29, wherein the thin covering is a wood veneer covering.

35. The elongate article of claim 29, wherein the first, second and third v-shaped cut-out regions are 90 degree v-shaped cut-out regions.

36. The elongate article of claim 29, including at least one additional v-shaped cut-out region and including at least one additional right side and left side segments, and at least one additional left side and right side points, to form a tapered leg having at least five sides.

37. A method of fabricating an elongate article comprising the steps of:

(a) providing a substrate;

(b) applying tape to the top surface of the substrate, (c) routing the substrate to provide an outer peripheral configuration having a top side, a bottom side, a left side, and a right side, wherein the top side and the bottom side are each generally straight and converge toward one another from the left side to the right side such that the left side of the outer peripheral configuration is relatively wide as compared to the right side of the outer peripheral configuration;

(d) routing a plurality of v-shaped cut-out regions in the substrate, each v-shaped cut-out region extending substantially through the substrate to the tape, but not through the tape, each v-shaped cut-out region extending in a substantially straight line from the left side to the right side of the outer peripheral configuration;

(e) mitering an angled surface on the top side and the bottom side, extending from the top surface to a bottom surface of the substrate, the angled surfaces angling inwardly from the top surface to the bottom surface at an angle;

(f) folding the substrate about the plurality of v-shaped cut-out regions, into the elongate article; and (g) removing the tape.

38. The method of claim 37, wherein the step of providing the substrate includes providing a substrate that is a laminate having a skin.

39. The method of claim 38, wherein the skin is a thin covering material selected from the group consisting of veneers and plastic laminates.

40. The method of claim 37, wherein the step of applying tape to the top surface of the substrate, includes applying the tape directly over the v-shaped cut-out regions.

41. The method of fabricating an elongate article of claim 37, including the step of bonding the substrate into the final tapered article after the step of folding.

42. An elongate article, comprising:

(a) a substrate comprising an outer peripheral configuration having a top side, a bottom side, a left side, and a right side, wherein the top side and the bottom side are each generally straight and converge toward one another from the left side to the right side such that the left side of the outer peripheral configuration is relatively wide as compared to the right side of the outer peripheral configuration;

(b) a plurality of v-shaped cut-out regions in the substrate, each v-shaped cut-out region extending substantially through the substrate, each v-shaped cut-out region extending in a substantially straight line from the left side to the right side of the outer peripheral configuration; and (c) an angled surface on each of the top side and the bottom side, extending from a top surface of the substrate to a bottom surface of the substrate, the angled surfaces angling inwardly from the top surface to the bottom surface at an angle.

43. The elongate article of claim 42, wherein the substrate is a laminate having a skin.

44. The elongate article of claim 43, wherein the skin is a thin covering material selected from the group consisting of veneers and plastic laminates.

* * * * *